US010480427B2

(12) United States Patent
Ishikawa et al.

(10) Patent No.: US 10,480,427 B2
(45) Date of Patent: Nov. 19, 2019

(54) CHOKE VALVE STRUCTURE

(71) Applicant: MARUYAMA MFG. CO., INC., Tokyo (JP)

(72) Inventors: Yoichi Ishikawa, Tokyo (JP); Terutaka Yasuda, Tokyo (JP); Toshihisa Nemoto, Tokyo (JP)

(73) Assignee: MARUYAMA MFG. CO., INC., Tokyo (JP)

( * ) Notice: Subject to any disclaimer, the term of this patent is extended or adjusted under 35 U.S.C. 154(b) by 3 days.

(21) Appl. No.: 15/373,436

(22) Filed: Dec. 8, 2016

(65) Prior Publication Data

US 2017/0167412 A1 Jun. 15, 2017

(30) Foreign Application Priority Data

Dec. 10, 2015 (JP) ..... 2015-241110

(51) Int. Cl.
*F02D 41/00* (2006.01)
*F02M 1/02* (2006.01)
*F02M 17/34* (2006.01)

(52) U.S. Cl.
CPC ..... *F02D 41/0002* (2013.01); *F02M 1/02* (2013.01); *F02M 17/34* (2013.01)

(58) Field of Classification Search
CPC ..... F02D 41/0002; F02D 9/1065; F02M 1/02; F02M 17/34
See application file for complete search history.

(56) References Cited

U.S. PATENT DOCUMENTS

| | | | | |
|---|---|---|---|---|
| 4,834,784 | A | 5/1989 | Bidanset | |
| 6,116,581 | A * | 9/2000 | Watanabe | F02B 63/02 261/64.6 |
| 2003/0037749 | A1 * | 2/2003 | Imafuku | F02B 63/02 123/179.16 |
| 2004/0187844 | A1 * | 9/2004 | Torii | F02D 9/104 123/337 |
| 2013/0098325 | A1 * | 4/2013 | Fukushima | F02M 17/34 123/184.23 |

(Continued)

FOREIGN PATENT DOCUMENTS

| | | |
|---|---|---|
| JP | H038653 U | 1/1991 |
| JP | H0547410 U | 6/1993 |

(Continued)

*Primary Examiner* — Joseph J Dallo
*Assistant Examiner* — Kurt Philip Liethen
(74) *Attorney, Agent, or Firm* — Moser Taboada

(57) ABSTRACT

A choke valve structure includes an air cleaner body having a suction pipe portion provided on an end wall, a choke valve having a valve body allowed to adhere to a sealing surface formed around an opening, and a movement mechanism configured to move the choke valve along a direction parallel to the sealing surface such that the valve body moves in closing and opening directions. A blowing back prevention plate disposed on an axial line of the suction pipe portion to face the opening is provided integrally with the air cleaner body. A protrusion, allowed to come into contact with the blowing back prevention plate when the valve body moves in the closing direction, is provided on the valve body. The valve body is pressed against the sealing surface to adhere thereto when the protrusion conies into contact with the blowing back prevention plate.

20 Claims, 6 Drawing Sheets

(56) References Cited

U.S. PATENT DOCUMENTS

2015/0285197 A1* 10/2015 Mutoh ..... F02M 35/044
123/184.21

FOREIGN PATENT DOCUMENTS

| | | | |
|---|---|---|---|
| JP | H6-029489 | | 8/1994 |
| JP | H0722054 | U | 4/1995 |
| JP | H11159400 | A | 6/1999 |
| JP | 2000234571 | A | 8/2000 |

* cited by examiner

CHOKE VALVE STRUCTURE

CROSS-REFERENCE TO RELATED APPLICATIONS

The disclosure is based upon and claims the benefit of priority from Japanese Patent Application No. 2015-241110, filed on Dec. 10, 2015, the entire contents of which are incorporated herein by reference.

TECHNICAL FIELD

The present disclosure relates to a choke valve structure.

BACKGROUND

For example, a choke valve is provided in a small two-stroke engine, or the like. The choke valve is provided between a carburetor and an air cleaner. The choke valve increases a fuel proportion to intake air by being closed at the time of starting an engine. Meanwhile, there is a known phenomenon referred to as "blowing back" in which a fuel flows backward from the carburetor to the air cleaner during driving of the engine. When blowing back occurs, the fuel is attached to the air cleaner to cause fuel sagging from an air cleaner box, or air content decreases due to humidity in an air cleaner element to cause a decrease in engine power. A blowing back prevention plate is provided between the carburetor and the air cleaner in some cases to reduce a problem due to blowing back. A large amount of fuel may be prevented from being attached to the air cleaner by the provision of the blowing back prevention plate.

Meanwhile, there is a known technology for enhancing tightness by the choke valve. For example, as described in Japanese Examined Utility Model Publication No. H6-29489, there is a known structure in which a choke plate is provided to block an air intake passage, and the choke plate and a choke lever are attached to a cleaner case. A cleaner cover is attached to the cleaner case. In the structure described in Japanese Examined Utility Model Publication No. H6-29489, a projection is provided on the choke plate, and a rib is provided on a rear surface of the cleaner cover. The rib is formed in an arc shape corresponding to a trajectory of the projection on the choke plate. The rib forms a tapered shape in a height direction.

SUMMARY

In the structure of Japanese Examined Utility Model Publication No. H6-29489, an object is to keep tightness by allowing the projection on the choke plate to move on the rib at the time of operation such that the choke plate is pressed against a choke seating surface. However, an attachment error, warping, or the like of the cleaner cover easily occur, and thus it is not easy to match a position of the rib provided on the rear surface of the cleaner cover to the projection of the choke plate. When the cleaner cover is attached while the projection is not matched with the rib, the above-described effect that the choke plate is pressed against the seating surface is not obtained.

The present disclosure describes a choke valve structure capable of reliably keeping tightness.

A choke valve structure according to an aspect of the disclosure is a choke valve structure for opening and closing an opening on an inlet side of an air inlet passage communicating with a carburetor provided in an engine, the choke valve structure including an air cleaner body connected to the carburetor, the air cleaner body having an end wall and a suction pipe portion provided on the end wall and included in at least a portion of the air inlet passage, a choke valve having a valve body allowed to adhere to a sealing surface formed around the opening, and a movement mechanism configured to move the choke valve along a direction parallel to the sealing surface such that the valve body moves in a closing direction in which the opening is closed and an opening direction in which the opening is opened, wherein a blowing back prevention plate is provided integrally with the air cleaner body, the blowing back prevention plate being disposed on an axial line of the suction pipe portion to face the opening, a protrusion is provided on the valve body of the choke valve, the protrusion protruding in a direction of the axial line from the valve body and being allowed to come into contact with the blowing back prevention plate when the movement mechanism operates and the valve body moves in the closing direction, and the valve body is pressed against the sealing surface to adhere to the sealing surface when the protrusion comes into contact with the blowing back prevention plate.

According to this choke valve structure, at the time of operating the engine, the blowing back prevention plate facing the opening receives a fuel flowing backward from the carburetor through the suction pipe portion, and inhibits the fuel from further flowing backward and diffusing. Meanwhile, when the movement mechanism operates to move the choke valve at the time of starting the engine, or the like, the opening is closed by the valve body moving in the closing direction. When the valve body moves in the closing direction, the protrusion comes into contact with the blowing back prevention plate.

In this way, the valve body is pressed against the sealing surface to adhere to the sealing surface. Since the blowing back prevention plate is provided integrally with the air cleaner body, a positional relation between the opening (or the sealing surface) and the blowing back prevention plate is invariable. Therefore, the protrusion and therefore the valve body may be reliably pressed against the sealing surface. As a result, tightness may be reliably kept.

The blowing back prevention plate may have a first surface on a side of the opening with which the protrusion conies into contact, and the first surface may be inclined with respect to the direction parallel to the sealing surface to press the valve body against the sealing surface as the valve body moves in the closing direction. According to this configuration, the valve body may be more reliably pressed against the sealing surface by the first surface serving as an inclined surface. Excellent tightness may be obtained without depending on a shape or rigidity of the choke valve.

The blowing back prevention plate may have a first surface on a side of the opening with which the protrusion comes into contact and a second surface on an opposite side from the first surface, and a rib for reinforcement may be provided on the second surface. According to this configuration, rigidity of the blowing back prevention plate may be enhanced.

The choke valve structure may further include a connecting portion that extends in the direction of the axial line and connects the end wall to the blowing back prevention plate, and the connecting portion may be positioned below the axial line of the suction pipe portion, and form a shape of a cylindrical surface which is open upward. According to this configuration, when the fuel flowing backward touches the blowing back prevention plate, and then drops, the fuel accumulates on the cylindrical surface of the connecting portion. In other words, the connecting portion serves as a receiver to prevent the fuel from diffusing. Since the connecting portion is connected to the end wall, the fuel may return to the carburetor through the opening and the suction pipe portion. Since the blowing-back fuel does not accumulate in a lower part of the air cleaner body, it is possible to prevent fuel sagging.

Some aspects of the disclosure make it possible to reliably press the valve body against the sealing surface, and to reliably keep tightness.

DETAILED DESCRIPTION

Hereinafter, an embodiment of the disclosure will be described with reference to drawings. In the embodiment below, a description will be given of a case in which a choke valve structure 1 is applied to a two-stroke engine 100 (hereinafter simply referred to as an engine 100).

Figure 1:
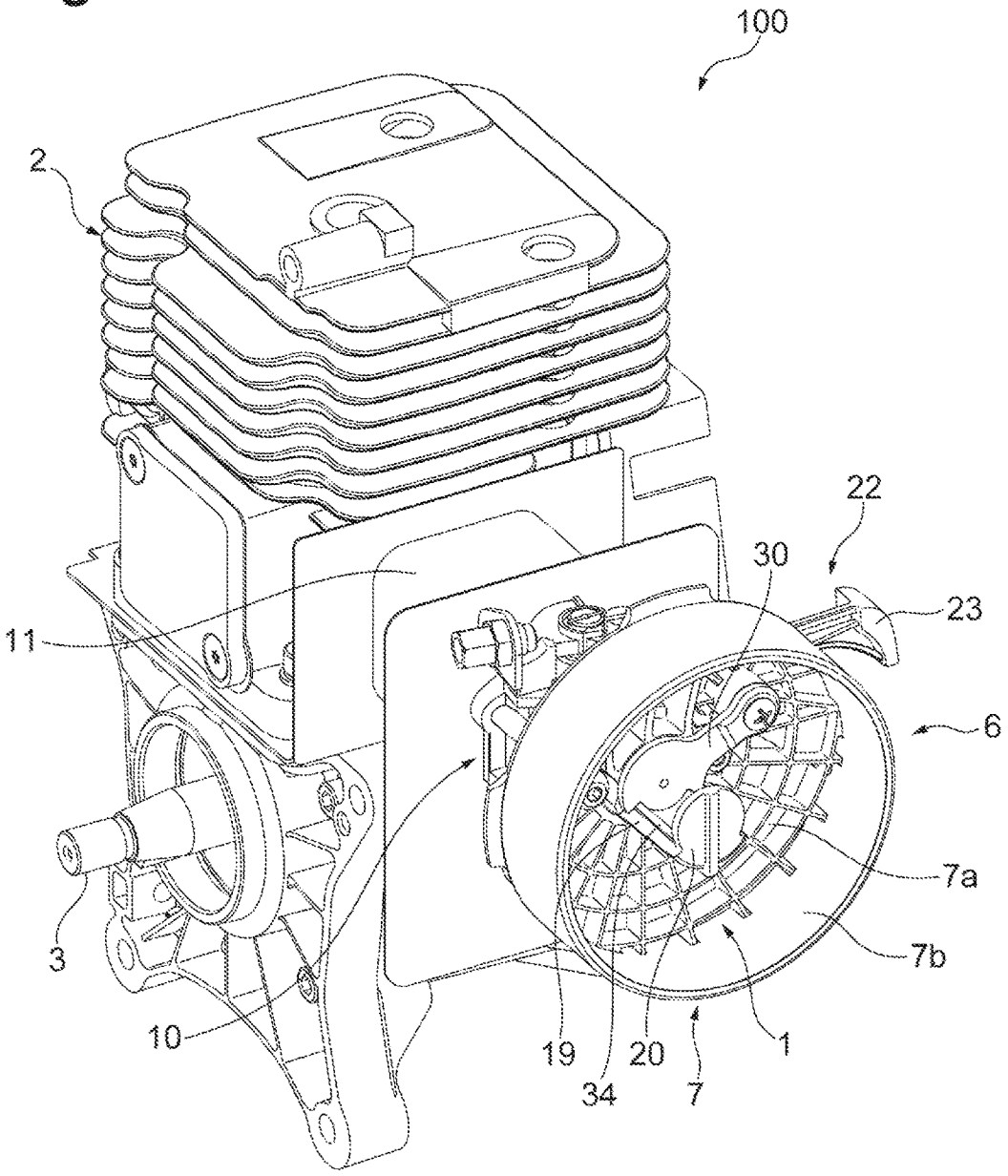
FIG. 1 is a perspective view of an engine to which a choke valve structure according to an embodiment of the disclosure is applied.
Figure 2:
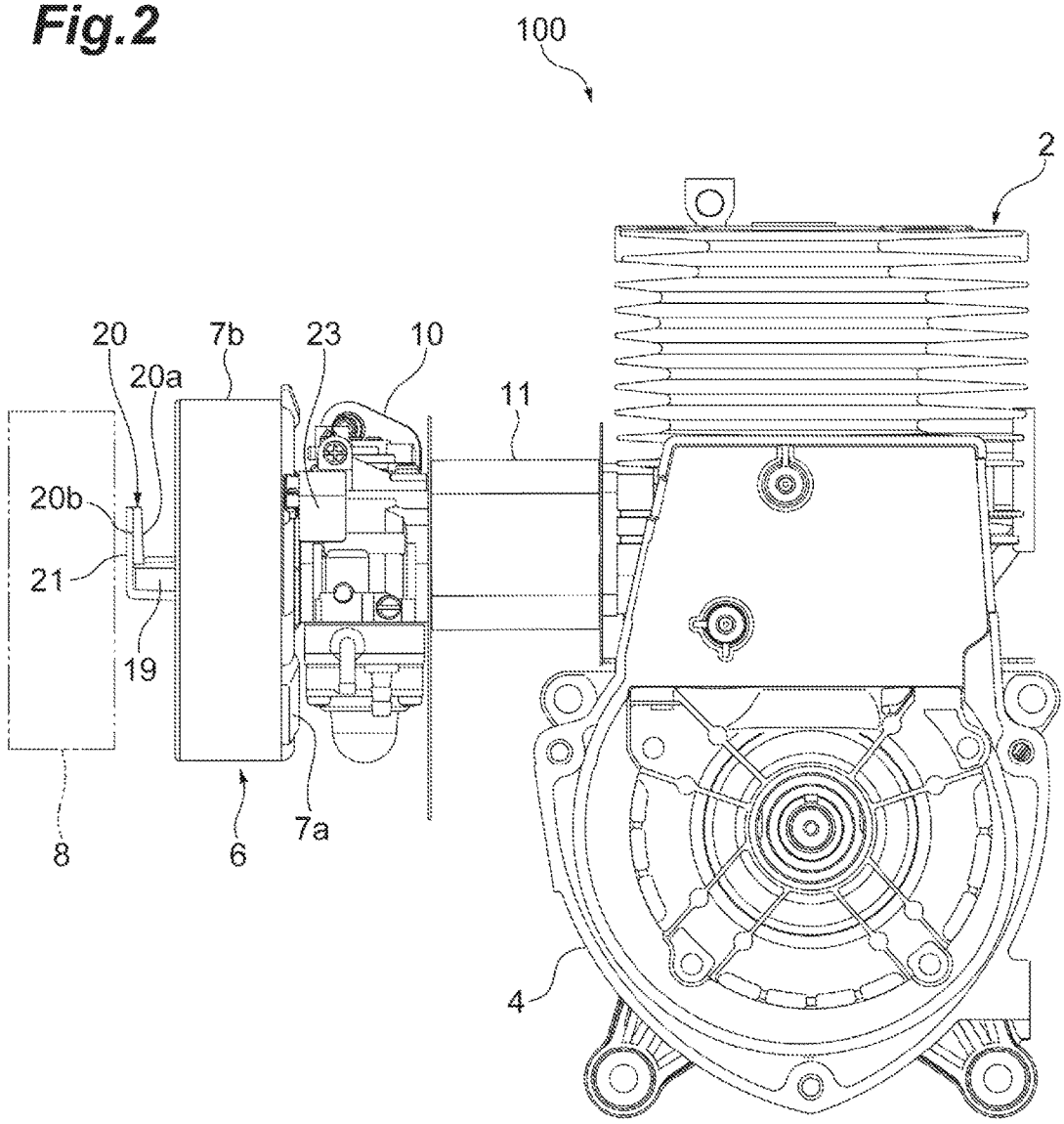
FIG. 2 is a side view of the engine of FIG. 1.

The engine 100 will be described with reference to FIG. 1 and FIG. 2. As illustrated in FIG. 1 and FIG. 2, for example, the engine 100 is a small (that is, a small displacement) two-stroke engine. The engine 100 includes a cylinder 2, a crankcase 4 connected to a lower part of the cylinder 2, and a crankshaft 3 protruding from the crankcase 4. The engine 100 further includes an air cleaner 6 that purifies intake air, a carburetor 10 connected to the air cleaner 6 to evaporate a fuel and generate an air-fuel mixture by mixing the fuel with air, and an insulator 11 that connects the cylinder 2 to the carburetor 10. For example, the engine 100 may be applied to an agricultural machine. The engine 100 burns the air-fuel mixture of the intake air and the fuel inside the cylinder 2, generates rotational driving power using a crank mechanism inside the crankcase 4, and delivers the rotational driving power through the crankshaft 3.

The air cleaner 6 is connected to the carburetor 10. The air cleaner 6 includes a cylindrical air cleaner body 7 having a bottom, and an air cleaner cover (not illustrated) having an air inlet. By fitting circumferential portions thereof to each other, an accommodation space of an air cleaner element 8 (see FIG. 2) is formed.

For example, the air cleaner body 7 is made of resin, and includes a disc-shaped end wall 7*a* facing the carburetor 10 and a cylindrical peripheral wall 7*b* connected to an outer circumferential portion of the end wall 7*a*. A cylindrical suction pipe portion 14 (see FIG. 5 and FIG. 6) communicating with a flow passage inside the carburetor 10 is provided in a central part of the end wall 7*a*. The air cleaner body 7 is fixed to the carburetor 10 by two through-holes 7*d* and 7*d* (see FIG. 4) provided at both sides of the suction pipe portion 14 and two bolts 12 and 12 (see FIG. 3) inserted into two sleeves 13 and 13.

Figure 6:
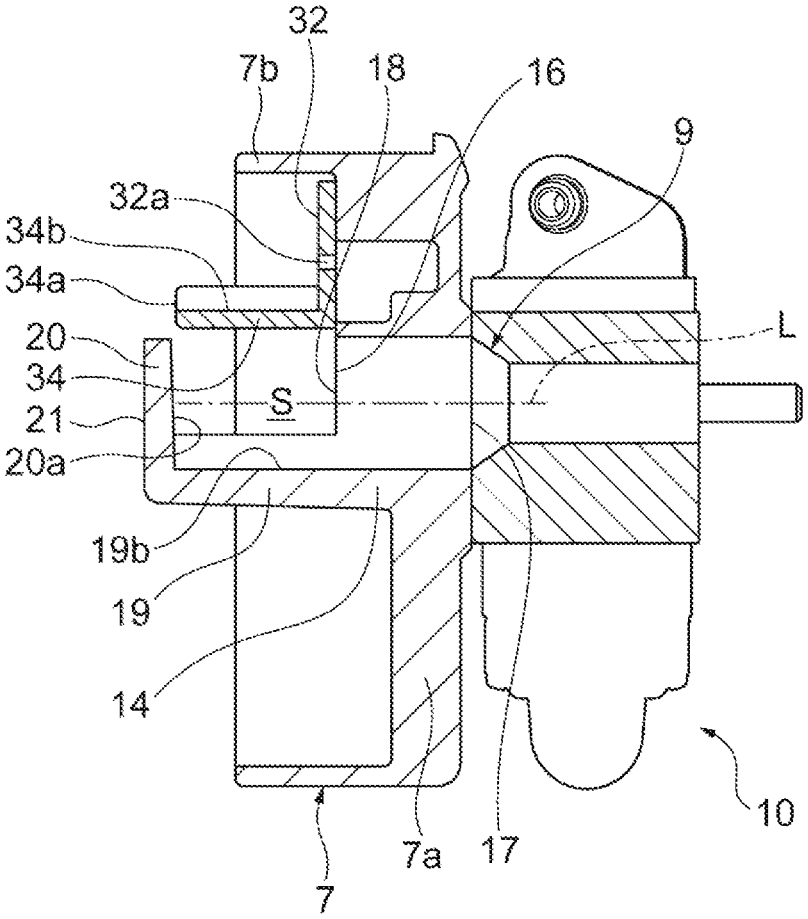
FIG. 6 is a cross-sectional view illustrating a state in which the choke valve is open.

An opening 16 (see FIG. 3) provided at an end portion of the suction pipe portion 14 on an inlet side is open toward the inside of the air cleaner 6. An opening 17 (see FIG. 4) provided at an end portion of the suction pipe portion 14 on an outlet side is connected to the inside of the carburetor 10. The suction pipe portion 14 is included in at least a portion (a portion or a whole) of an air inlet passage 9 through which air sucked into the engine 100 passes. The air inlet passage 9 communicates with the carburetor 10. As illustrated in FIG. 6, for example, a center axis line L (hereinafter simply referred to as an axial line L) of the suction pipe portion 14 extends in a direction approximately perpendicular to the end wall 7*a*. A direction in which the suction pipe portion 14 is provided is not restricted thereto, and may be appropriately changed.

As illustrated in FIG. 1, a choke valve 30 for adjusting the amount of air passing through the air inlet passage 9 is provided in the air cleaner 6. For example, the choke valve 30 is made of resin. The choke valve 30 is operated using a movement mechanism 22 to move inside the air cleaner 6, and opens and closes the opening 16 on an inlet side of the air inlet passage 9. More specifically, the choke valve 30 closes the opening 16 by adhering to a sealing surface 18 formed around the opening 16. The sealing surface 18 is formed perpendicular to the axial line L, and forms a ring shape centering on the axial line L. For example, the choke valve 30 compresses (reduces) intake air content by closing the opening 16 at the time of starting the engine. In this way, a fuel proportion to the air-fuel mixture is increased.

Next, a description will be given of the choke valve structure 1 in which the choke valve 30 is attached to the air cleaner 6. The choke valve structure 1 is a structure for opening and closing the opening 16 of the air inlet passage 9 communicating with the carburetor 10. The choke valve structure 1 of the present embodiment allows high tightness to be reliably kept through a simple operation when the choke valve 30 is closed by having a unique structure described below.

Figure 3:
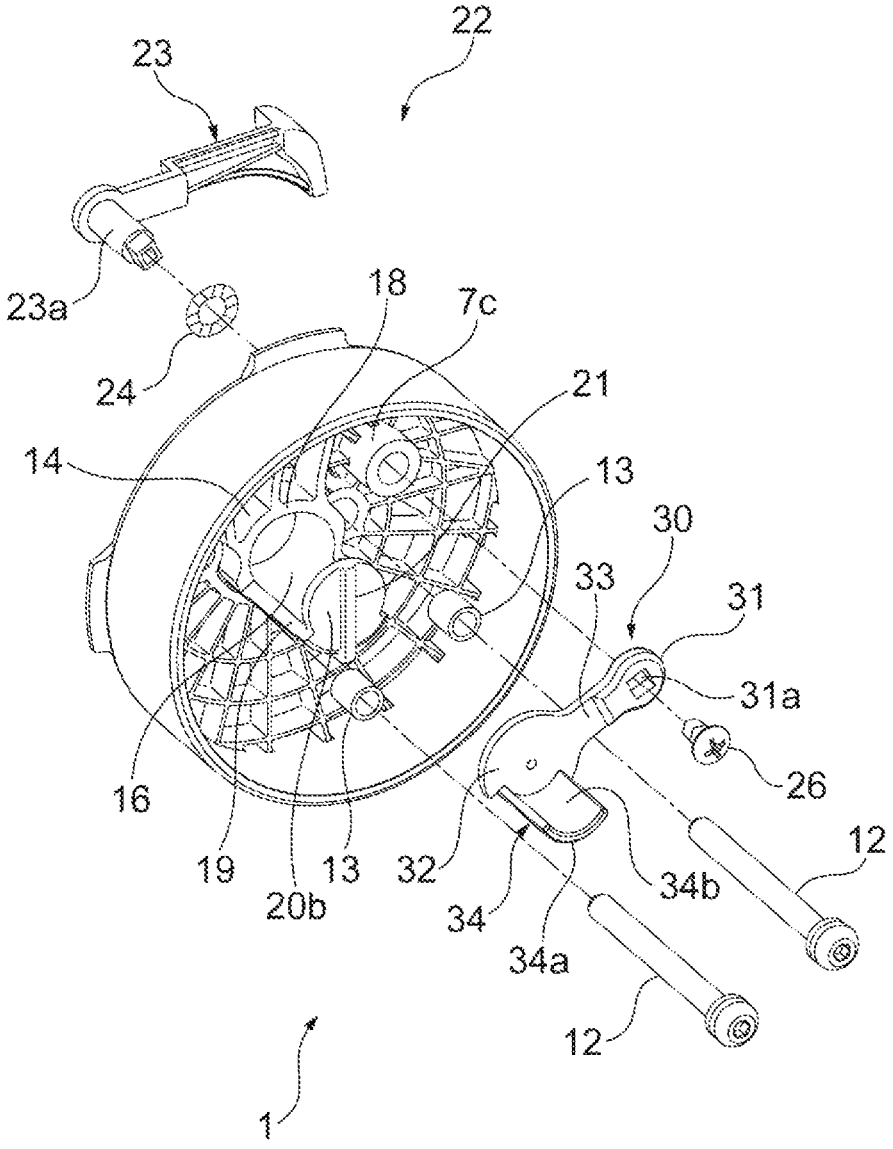
FIG. 3 is an exploded perspective view of an air cleaner and a choke valve.
Figure 4:
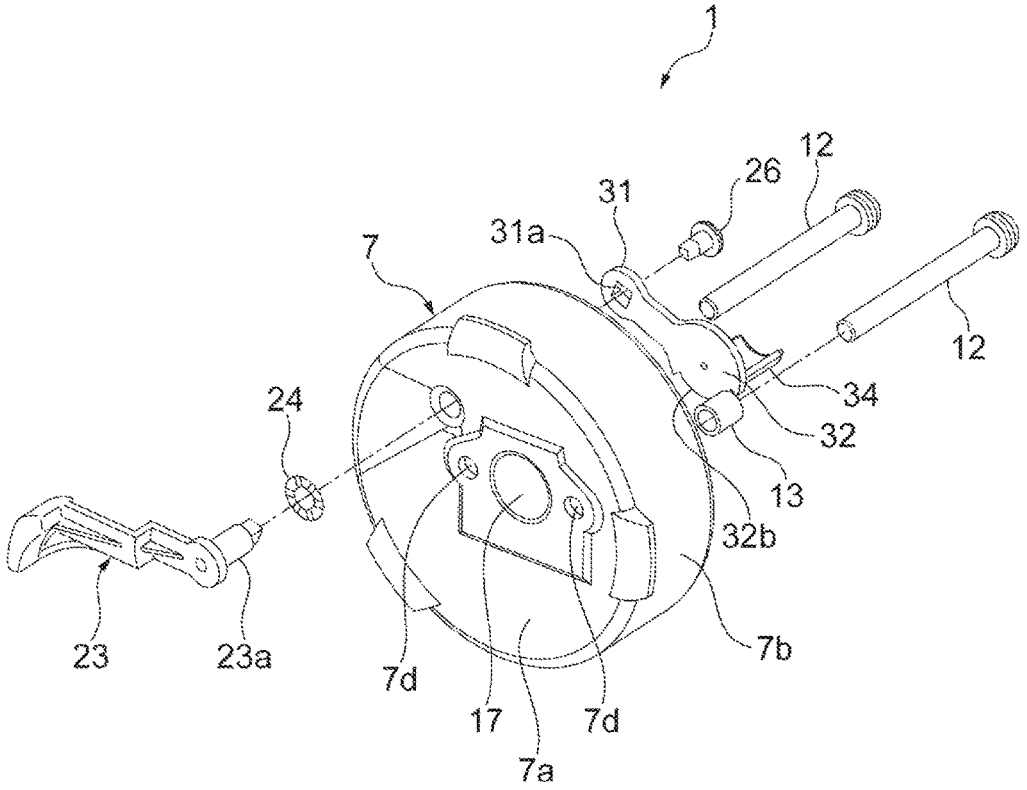
FIG. 4 is an exploded perspective view of FIG. 3 viewed from a rear surface side.

As illustrated in FIG. 1 and FIG. 3, the choke valve 30 includes a base portion 31 coupled with a shaft portion 23*a* of a lever 23 through a cylindrical bearing 7*c* of the end wall 7*a*, a disc-shaped valve body 32 that may adhere to the sealing surface 18 of the end wall 7*a*, and an arm portion 33 that connects the base portion 31 to the valve body 32. A washer 24 is interposed between the bearing 7*c* and the lever 23. The lever 23 is attached to the end wall 7*a* by screwing a screw 26 into the shaft portion 23*a* inserted into the washer 24, the bearing 7*c*, and the through-hole 31*a* of the base portion 31. The movement mechanism 22 includes the lever 23 including the shaft portion 23*a*, the bearing 7*c*, the through-hole 31*a* of the base portion 31, the screw 26, or the like.

The shaft portion 23*a* is rotatable inside the bearing 7*c*. When the lever 23 is raised and lowered by an operator, the choke valve 30 moves along a direction parallel to the sealing surface 18 (that is, along a virtual plane parallel to the sealing surface 18). More specifically, the arm portion 33 and the valve body 32 oscillate along an arc-shaped. trajectory.

The valve body 32 has both flat surfaces. The movement mechanism 22 is configured to move the choke valve 30 such that the valve body 32 moves in a closing direction (specifically downward) that is a direction in which the opening 16 is closed, and the valve body 32 moves in an opening direction (specifically upward) that is a direction in which the opening 16 is opened. A movement range of the choke valve 30 is a range between an open position (see FIG. 6) at which the opening 16 is fully open and a closed position (see FIG. 5) at which the opening 16 is fully closed. The movement mechanism 22 is able to stop the choke valve 30 at an appropriate position midway between the open position and the closed position.

The choke valve structure 1 includes a blowing back prevention plate 20 for restraining a fuel that flows backward inside the air cleaner 6 (a so-called blowing-back fuel). The blowing back prevention plate 20 forms a disc shape having a predetermined thickness. The blowing back prevention plate 20 is disposed on the axial line L of the suction pipe portion 14, and faces the opening 16. The blowing back prevention plate 20 is provided at an outer side (the air cleaner element 8 side) of the opening 16 of the suction pipe portion 14. The blowing back prevention plate 20 is disposed such that a central part thereof is positioned on the axial line L. For example, the blowing back prevention plate 20 extends perpendicular to the axial line L. In other words, the blowing back prevention plate 20 is provided parallel to the sealing surface 18. A position at which the blowing back prevention plate 20 is provided and a direction in which the blowing back prevention plate 20 is provided are not restricted to the above modes. The blowing back prevention plate 20 may be disposed such that a part displaced from the central part thereof is positioned on the axial line L. The blowing back prevention plate 20 may be provided to be inclined with respect to the axial line L. Only a portion of the blowing back prevention plate 20 may directly face the opening 16.

The blowing back prevention plate 20 is provided integrally with the air cleaner body 7. More specifically, the blowing back prevention plate 20 is provided integrally with the end wall 7*a*. In the choke valve structure 1 of the present embodiment, the blowing back prevention plate 20 is connected to the end wall 7*a* by a connecting portion 19 that extends in a direction of the axial line L. The connecting portion 19 is disposed between the suction pipe portion 14 on the end wall 7*a* and the blowing back: prevention plate 20 to connect the suction pipe portion 14 to the blowing back prevention plate 20. The blowing back prevention plate 20, the connecting portion 19, and the end wall 7*a* may be integrally molded. The blowing back prevention plate 20, the connecting portion 19, and the end wall 7*a* may be separately molded, and then joined to one another using adhesion, welding, or the like. In such an integrated structure, a positional relation, that is, a distance between the blowing back prevention plate 20 and the sealing surface 18 (or the opening 16) is fixed and invariable.

As illustrated in. FIG. 2, FIG. 3, and FIG. 6, the blowing back prevention plate 20 has a first surface 20*a* on a side of the suction pipe portion 14, that is, the opening 16, and a second surface 20*b* on an opposite side from the first surface 20*a*. One rib 21 for reinforcement extending in a vertical direction is provided on the second surface 20*b*. The rib 21 provided in a range corresponding to a diameter of the second surface 20*b* enhances rigidity of the blowing back prevention plate 20. The rib provided on the second surface 20*b* is not restricted to one linear rib. A plurality of parallel ribs may be provided, or a cross-shaped or grid-shaped rib may be provided.

The connecting portion 19 will be described in more detail. As illustrated in FIG. 3 and FIG. 6, the connecting portion 19 forms a cylindrical surface shape which is open upward. The connecting portion 19 forms the same shape as that of a portion of a cylinder in a circumferential direction. The connecting portion 19 has a cylindrical surface 19*b* which is concave up. The connecting portion 19 and the cylindrical surface 19*b* are positioned below the axial line L. A range in which the connecting portion 19 and the cylindrical surface 19*b* are provided is less than 180 degrees with respect to a central angle of a cylinder. In other words, the connecting portion 19 forms a shape in which a range corresponding to a central axis greater than or equal to 180 degrees is cut in the cylinder.

In the present embodiment, the connecting portion 19 is formed to be continued to the suction pipe portion 14 of the end wall 7*a*. A radius of curvature of the cylindrical surface 19*b* is equal to a radius of the suction pipe portion 14. As illustrated in FIG. 6, a thickness of a lower part of the suction pipe portion 14 is equal to a thickness of the connecting portion 19. In the direction of the axial line L, no step is formed at a position of the sealing surface 18 (that is, a position of the opening 16). Therefore, an inner surface of the lower part of the suction pipe portion 14 is flush with the cylindrical surface 19*b* of the connecting portion 19, and the inner surface is smoothly connected to the cylindrical surface 19*b*. In other words, the suction pipe portion 14 and the connecting portion 19 are formed in one cylindrical shape commonly centering on the axial line L. The connecting portion 19 forms a shape obtained by cutting a portion corresponding to a central angle of the suction pipe portion 14 greater than or equal to 180 degrees on an outer side (the blowing back prevention plate 20 side) of the sealing surface 18 in the direction of the axial line L. In particular, when the end wall 7*a* and the connecting portion 19 are integrally molded, a joint is not formed at a position of the sealing surface 18 in the direction of the axial line L.

According to such a configuration, the sealing surface 18 is formed as a surface perpendicular to the axial line L in a range corresponding to the central angle greater than or equal to 180 degrees (upper part). In a range of a lower part in which the connecting portion 19 is provided, the sealing surface 18 is terminated, and is not formed as the surface perpendicular to the axial line L. A cylindrical space S is formed between the sealing surface 18 and the blowing back prevention plate 20 and over the connecting portion 19.

As described above, the connecting portion 19 forms a shape of a cullis. The connecting portion. 19 and the suction pipe portion 14 are connected to each other, and the connecting portion 19 and the blowing back prevention plate 20 are connected to each other. Therefore, a fuel touching the blowing back prevention plate 20 falls onto the first surface 20*a* and accumulates on the cylindrical surface 19*b* of the connecting portion 19. The fuel accumulating on the cylindrical surface 19*b* may be returned to the carburetor 10 through the connecting portion 19. In particular, When the inner surface of the lower part of the suction pipe portion 14 is flush with the cylindrical surface 19*b* of the connecting portion 19, the blowing-back fuel easily returns to the carburetor 10, and thus returning efficiency of the blowing-back fuel is enhanced.

Next, a more detailed description will be given of a configuration of the choke valve 30 in the choke valve structure 1. As illustrated in FIG. 3, a protrusion 34 protruding in the direction of the axial line L is provided integrally with the disc-shaped valve body 32. The protrusion 34 is provided in a lower part of the valve body 32, and protrudes in a direction perpendicular to the valve body 32 (that is, parallel to the axial line L). The valve body 32 and the protrusion 34 may be integrally molded, or may be separately molded, and then joined to each other using adhesion, welding, or the like.

The protrusion 34 forms a shape of a cylindrical surface which is open upward. The protrusion 34 forms the same shape as that of a portion of a cylinder in a circumferential direction. The protrusion 34 has a cylindrical surface 34*b* which is concave up. The protrusion 34 and the cylindrical surface 34*b* are formed to be concentric with the valve body 32. A range in which the protrusion 34 and the cylindrical surface 34*b* are formed is less than 180 degrees with reference to a central angle of the cylinder. In other words, the protrusion 34 forms a shape obtained by cutting a range corresponding to the central angle of 180 degrees or more in the cylinder. Therefore, a distal end portion 34*a* of the protrusion 34 forms the same shape as that of a portion of an arc having a predetermined width.

Figure 5:
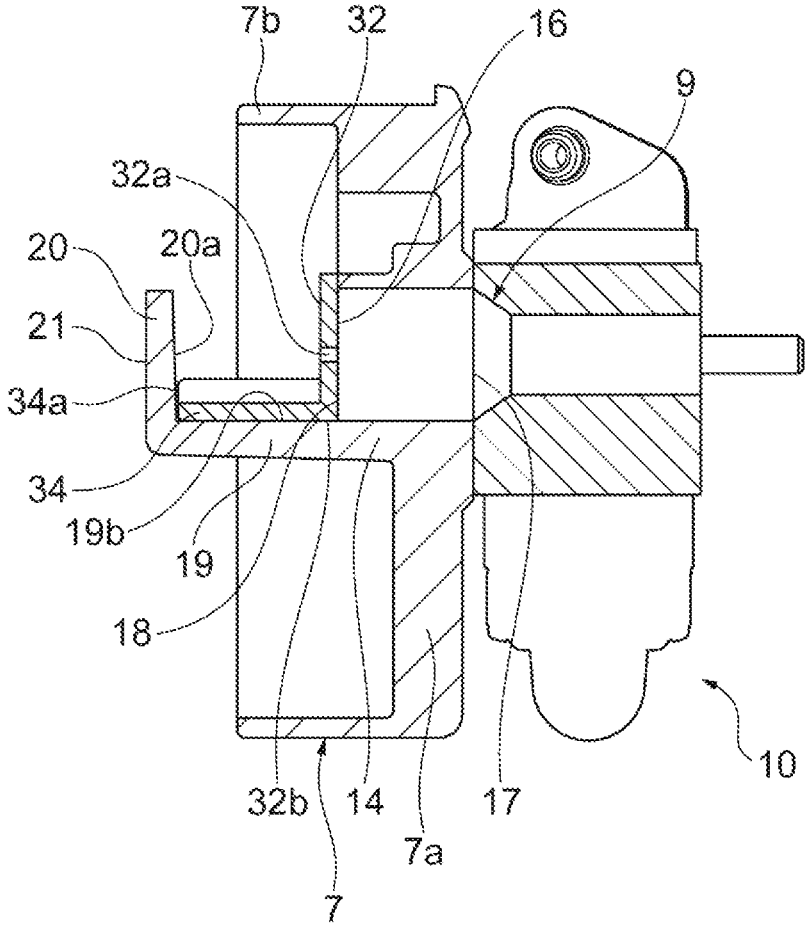
FIG. 5 is a cross-sectional view illustrating a state in which the choke valve is closed.

As illustrated in FIG. 5, a radius of the valve body 32 is approximately equal to a radius of an outermost circumferential portion of the sealing surface 18. A radius of curvature of the protrusion 34 is smaller than the radius of the valve body 32 with reference to a central line common to the valve body 32 and the protrusion 34. Further, the lower part of the valve body 32 ends at a lower end of the protrusion 34, and a lower edge portion 32*b* flush with a lower surface of the protrusion 34 appears (see FIG. 4). A radius of curvature of the lower surface of the protrusion 34, that is, a radius of curvature of the lower edge portion 32*b* is approximately equal to the radius of curvature of the cylindrical surface 19*b* of the connecting portion 19.

When the choke valve 30 is moved from the open position to the closed position by the movement mechanism 22, the valve body 32 and the protrusion 34 move inside the space S and are put in the space S. When the choke valve 30 is at the closed position due to the above-described relation between the radiuses of curvature (the radiuses of curvature are approximately equal to each other), the lower edge portion 32*b* of the valve body 32 adheres to the cylindrical surface 19*b* of the connecting portion 19 (see FIG. 5). When the choke valve 30 is at the closed position, the protrusion 34 and the cylindrical surface 34*b* are positioned below the axial line L of the suction pipe portion 14, and a central line of the protrusion 34 and the cylindrical surface 34*b* approximately matches the axial line L.

When the choke valve 30 is moved from the open position to the closed position by the movement mechanism 22, that is, when the movement mechanism 22 is operated, and the valve body 32 is moved in a closing direction, the distal end portion 34*a* of the protrusion 34 is able to come into contact with the first surface 20*a* of the blowing back prevention plate 20. In other words, a whole length in the direction of the axial line L obtained by adding a length of the protrusion 34 to a thickness of the valve body 32 (hereinafter referred to as a whole length of the choke valve 30 in the direction of the axial line L) is slightly smaller than the distance between the blowing back prevention plate 20 and the sealing surface 18.

When the distal end portion 34*a* comes into contact with the first surface 20*a* of the blowing back prevention plate 20, the protrusion 34 receives a pressing force in the direction of the axial line L. In this way, a circumferential portion of the valve body 32 is pressed against the sealing surface 18 to adhere to the sealing surface 18. At the same time, the lower edge portion 32*b* of the valve body 32 adheres to the cylindrical surface 19*b* of the connecting portion 19. In other words, even though the lower part of the sealing surface 18 is terminated as described above, the cylindrical surface 19*b* of the connecting portion 19, being continued from the sealing surface 18, serves as a sealed portion. The valve body 32 and the protrusion 34 have a shape corresponding to a shape of a sealed portion on the end wall 7*a* side, and are joined to the sealed portion without any gap. A joined portion is a joined surface having a predetermined width, that is, an area rather than a linear shape.

As illustrated in FIG. 1 and FIG. 5, the choke valve 30 at the closed position closes the opening 16 with the circumferential portion and the lower edge portion 32*b* of the valve body 32. An air intake hole 32*a* is provided at a center of the valve body 32, for ensuring a minimum air intake amount in a closed state of the opening 16, that is, a state in which the fuel proportion is increased to a highest level due to sealing by the valve body 32.

In the choke valve structure 1 of the present embodiment, in particular, the first surface 20*a* serves as an inclined surface. The first surface 20*a* is inclined with respect to the direction parallel to the sealing surface 18 (that is, the virtual plane parallel to the sealing surface 18). The first surface 20*a* is inclined to approach the sealing surface 18 in the direction of the axial line L from an upper part toward a lower part. In other words, a thickness of the blowing back prevention plate 20 increases from the upper part toward the lower part. In this way, the first surface 20*a* is inclined to press the valve body 32 against the sealing surface 18 as the movement mechanism 22 is operated to move the valve body 32 in the closing direction.

In a mode in which the first surface 20*a* is inclined, a distance between the upper part of the first surface 20*a* and the sealing surface 18 is longer than the whole length of the choke valve 30 in the direction of the axial line L by a certain distance. Therefore, when the distal end portion 34*a* of the protrusion 34 faces the upper part of the first surface 20*a*, a slight gap or play is present therebetween. Meanwhile, a distance between the lower part of the first surface 20*a* and the sealing surface 18 is approximately equal to or extremely slightly longer than the whole length of the choke valve 30 in the direction of the axial line L. Therefore, when the distal end portion 34*a* of the protrusion 34 faces and comes into contact with the lower part of the first surface 20*a*, neither a gap nor play is present therebetween. In this way, as the choke valve 30 is lowered, the protrusion 34 is gradually pressed to the sealing surface 18 side by the first surface 20*a* while coming into contact with the first surface 20*a*. In this way, the valve body 32 reliably adheres to the sealing surface 18, and sufficient tightness is achieved.

A description will be given of the engine 100 to which the choke valve structure 1 is applied. At the time of starting the engine 100, the. lever 23 is raised, the choke valve 30 is moved, and the valve body 32 is moved to have the same center core as that of the sealing surface 18. In this instance, the choke valve 30 is lowered as the distal end portion 34*a* of the protrusion 34 provided integrally with the choke valve 30 comes into contact with the first surface 20*a* of the blowing back prevention plate 20 provided integrally with the air cleaner body 7. As the choke valve 30 is further lowered, a surface of the valve body 32 is pressed against the sealing surface 18, and the choke valve 30 moves up to the closed position (see FIG. 1 and FIG. 5). In this way, excellent tightness and sealing property are stably ensured without depending on a shape or rigidity of the choke valve 30. An air-fuel mixture having a high fuel proportion is generated by minimum intake air through the air intake hole 32*a* and an engine starting fuel drawn from the carburetor 10. It is important to ensure tightness at the time of starting the engine 100. In this regard, the choke valve structure 1 exhibits a great effect.

At the time of proceeding to a steady operation of the engine 100, the lever 23 is lowered, and the choke valve 30 moves up to the open position (see FIG. 6). When the fuel flows backward through the suction pipe portion 14 (the air inlet passage 9) and the opening 16, the fuel collides with the blowing back prevention plate 20, drops, and accumulates in the plate-shaped connecting portion 19. The accumulating fuel turned to the carburetor 10 through the suction pipe portion 14.

According to the choke valve structure 1 of the present embodiment, at the time of operating the engine 100, the blowing back prevention plate 20 facing the opening 16 receives the fuel flowing backward from the carburetor 10 through the suction pipe portion 14, and inhibits the fuel from further flowing backward and diffusing. Meanwhile, when the movement mechanism 22 operates to move the choke valve 30 at the time of starting the engine 100, the opening 16 is closed by the valve body 32 moving in the closing direction. When the valve body 32 moves in the closing direction, the protrusion 34 comes into contact with the blowing back prevention plate 20. In this way, the valve body 32 is pressed against the sealing surface 18 to adhere to the sealing surface 18. Since the blowing back prevention plate 20 is formed integrally with the aft cleaner body 7, the positional relation between the opening 16 (or the sealing surface 18) and the blowing back prevention plate 20 is fixed and invariable. Therefore, the protrusion 34 and therefore the valve body 32 may be reliably pressed against the sealing surface 18. As a result, tightness may he reliably kept. Furthermore, the fuel is prevented from being attached to the air cleaner element 8 inside the air cleaner body 7 to cause a decrease in power. Structural unstability as in Japanese Examined Utility Model Publication No. H6-29489in which the rib is provided on the air cleaner cover is resolved. In addition, in the past, there has been a possibility that excellent tightness between the valve body and sealing surface may not be obtained, and a poor starting property of the engine may be caused when rigidity of the choke valve or the air cleaner body made of resin is insufficient. However, according to the choke valve structure 1, such a case is prevented.

Since the blowing back prevention plate 20 is provided integrally with the air cleaner body 7, the number of parts decreases, and cost is reduced. When the blowing back prevention plate is separated from the air cleaner body 7, there is a possibility that the. blowing back prevention plate may be erroneously assembled or forgotten to be assembled at the time of assembly. However, such a possibility is excluded when the blowing back prevention plate 20 is integrally provided.

In addition, when the first surface 20*a* of the blowing back prevention plate 20 serves as the inclined surface, the valve body 32 may be more reliably pressed against the sealing surface 18. Excellent tightness may be obtained without depending on the shape or rigidity of the choke valve 30.

In addition, since the rib 21 for reinforcement is provided on the second surface 20*b* of the blowing back prevention plate 20, rigidity of the blowing back prevention plate 20 is enhanced. Even when the blowing back prevention plate 20 is made of resin, if rigidity is enhanced by the rib 21, the choke valve 30 may be reliably pressed.

Since the connecting portion 19 positioned below the axial line L forms the shape of the cylindrical surface which is open upward, when the fuel flowing backward touches the blowing back prevention plate 20, and then drops, the fuel accumulates on the cylindrical surface 19*b* of the connecting portion 19. In other words, the connecting portion 19 serves as a receiver to prevent the fuel from diffusing. Since the connecting portion 19 is connected to the end wall 7*a*, the fuel may return to the carburetor 10 through the opening 16 and the suction pipe portion 14. Since the blowing-back fuel does not accumulate in a lower part of the air cleaner body 7, it is possible to prevent fuel sagging from the air cleaner 6. According to the connecting portion 19 having the shape of the cylindrical surface, rigidity of the connecting portion 19 is enhanced even when the connecting portion 19 is made of resin.

Hereinbefore, the embodiment of the disclosure has been described. However, the invention is not restricted to the above embodiment. For example, the shape of the blowing back prevention plate is not restricted to the disc shape. The blowing back prevention plate may have a rectangular plate shape. The rib may be omitted on the second surface 20*b* of the blowing back prevention plate. Rigidity may be enhanced by increasing a plate thickness of the blowing back prevention plate. The first surface 20*a* may not be the inclined surface, and may be a surface parallel to the sealing surface 18.

The choke valve may not rotate from an upper side to a lower side. For example, it is possible to employ a configuration in which the choke valve rotates from the lower side toward the upper side, or employ a configuration in which the choke valve slides in a transverse direction. In a case where an inclined surface is provide on the first surface, it is possible to employ a mode in which an inclination is provided according to a movement direction of the valve body.

The connecting portion may have a shape of a semicylinder (a central angle of 180 degrees). The connecting portion may not have the shape of the cylindrical surface. The connecting portion may have a U-shaped cross section perpendicular to the axial line L. The connecting portion may not be provided on the end wall 7*a*, and may be provided on the peripheral wall 7*b*. In this case, the blowing back prevention plate 20 is provided integrally with the peripheral wall 7*b*. The blowing back prevention plate 20 may be provided integrally with the air cleaner body 7.

The protrusion provided on the valve body may not have the shape of the cylindrical surface. The protrusion may have a shape of a flat plate or a bar. In a case where the connecting portion has the U-shaped cross section, the protrusion may have a U-shaped cross section smaller than the U-shaped cross section of the connecting portion by a size, and the protrusion may be configured to be put inside the connecting portion.

A length of the suction pipe portion 14 in the direction of the axial line L may be extremely short. The length of the suction pipe portion 14 may approximately correspond to a plate thickness of the end wall 7*a*. The movement mechanism is not restricted to the manual movement mechanism 22, and may be an automatically controlled movement mechanism.

Then engine is not restricted to the two-stroke engine, and may be a four-stroke engine. The displacement of the engine is not particularly restricted. The invention is applicable to every internal-combustion engine in which blowing back may occur.

What is claimed is:

1. A choke valve structure for opening and closing an opening on an inlet side of an air inlet passage communicating with a carburetor provided in an engine, the choke valve structure comprising:

an air cleaner body connected to the carburetor, the air cleaner body having an end wall and a suction pipe portion provided on the end wall and included in at least a portion of the air inlet passage, the suction pipe portion having an axial line;

a choke valve having a valve body to adhere to a sealing surface formed around the opening, the valve body being configured to move in a closing direction in which the opening is closed and an opening direction in which the opening is opened, the valve body having an edge part which rotationally moves in the closing direction and the opening direction;

a movement mechanism configured to move the choke valve along a direction parallel to the sealing surface such that the valve body moves in the closing direction and the opening direction;

a blowing back prevention plate provided integrally with the air cleaned body, the blowing back prevention plate having a disc shape and being disposed on the axial line to face the opening; and a protrusion provided on the edge part of the valve body of the choke valve, the protrusion protruding in a direction of the axial line from the valve body and configured to come into sliding contact with the blowing back prevention plate when the movement mechanism operates and the valve body moves in the closing direction, wherein the valve body is pressed against the sealing surface to adhere to the sealing surface when the protrusion comes into contact with the blowing back prevention plate, and wherein a diameter of the blowing back prevention plate is equal to an inner diameter of the suction pipe portion, and wherein the protrusion is configured to make sliding contact with the blowing back prevention plate along substantially an entire length of the diameter of the blowing back prevention plate.

2. The choke valve structure according to claim 1, wherein the blowing back prevention plate has a first surface on a side of the opening with which the protrusion comes into contact, and the first surface is inclined with respect to the direction parallel to the sealing surface to press the valve body against the sealing surface as the valve body moves in the closing direction.

3. The choke valve structure according to claim 1, wherein the blowing back prevention plate has a first surface on a side of the opening with which the protrusion comes into contact and a second surface on an opposite side from the first surface, and a rib for reinforcement is provided on the second surface.

4. The choke valve structure according to claim 1, further comprising a connecting portion that extends in the direction of the axial line and connects the end wall to the blowing back prevention plate.

5. The choke valve structure according to claim 4, wherein the connecting portion is positioned below the axial line of the suction pipe portion, and forms a shape of a cylindrical surface which is open upward.

6. The choke valve structure according to claim 1, wherein the choke valve configured to rotate around a shaft portion provided in the end wall.

7. The choke valve structure according to claim 6, wherein the movement mechanism has a lever disposed outside the air cleaner body, the shaft portion being attached to the lever.

8. The choke valve structure according to claim 1, wherein the protrusion is configured to come into sliding contact with the blowing back prevention plate prior to the protrusion passing through the axial line when the valve body moves in the closing direction.

9. A choke valve structure for opening and closing an opening on an inlet side of an air inlet passage communicating with a carburetor provided in an engine, the choke valve structure comprising:

an air cleaner body connected to the carburetor, the air cleaner body having an end wall and a suction pipe portion provided on the end wall and included in at least a portion of the air inlet passage;

a choke valve having a valve body to adhere to a sealing surface formed around the opening;

a movement mechanism configured to move the choke valve along a direction parallel to the sealing surface such that the valve body moves in a closing direction in which the opening is closed and an opening direction in which the opening is opened;

a blowing back prevention plate is provided integrally with the air cleaner body, the blowing back prevention plate having a disc shape and being disposed on an axial line of the suction pipe portion to face the opening; and a protrusion provided on the valve body of the choke valve, the protrusion protruding in a direction of the axial line from the valve body and configured to come into sliding contact with the blowing back prevention plate when the movement mechanism operates and the valve body moves in the closing direction;

wherein the valve body is pressed against the sealing surface to adhere to the sealing surface when the protrusion comes into contact with the blowing back prevention plate, the blowing back prevention plate has a contact surface on a side of the opening with which the protrusion comes into contact, wherein the blowing back prevention plate has a thickness which gradually increases from an upper part where the protrusion first comes into contact with the blowing back prevention plate toward a lower part where the protrusion remains in contact with the blowing back prevention plate when the valve body moves in the closing direction, such that the contact surface is inclined with respect to the direction parallel to the sealing surface to press the valve body against the sealing surface as the valve body moves in the closing direction, wherein the contact surface of the blowing back prevention plate having a width which is greater than the thickness, and wherein a diameter of the blowing back prevention plate is equal to an inner diameter of the suction pipe portion, and wherein the protrusion is configured to make sliding contact with the blowing back prevention plate along substantially an entire length of the diameter of the blowing back prevention plate.

10. The choke valve structure according to claim 9, wherein the blowing back prevention plate has a second surface on an opposite side from the contact surface, and a rib for reinforcement is provided on the second surface.

11. The choke valve structure according to claim 9, further comprising a connecting portion that extends in the direction of the axial line and connects the end wall to the blowing back prevention plate.

12. The choke valve structure according to claim 11, wherein the connecting portion is positioned below the axial line of the suction pipe portion, and forms a shape of a cylindrical surface which is open upward.

13. The choke valve structure according to claim 9, wherein the choke valve configured to rotate around a shaft portion provided in the end wall.

14. The choke valve structure according to claim 13, wherein the movement mechanism has a lever disposed outside the air cleaner body, the shaft portion being attached to the lever.

15. The choke valve structure according to claim 9, wherein the protrusion first comes into contact with the blowing back prevention plate and before the protrusion passes through the axial line when the valve body moves in the closing direction.

16. A choke valve structure for opening and closing an opening on an inlet side of an air inlet passage communicating with a carburetor provided in an engine, the choke valve structure comprising:

an air cleaner body connected to the carburetor, the air cleaner body having an end wall and a suction pipe portion provided on the end wall and included in at least a portion of the air inlet passage;

a choke valve having a valve body to adhere to a sealing surface formed around the opening;

a movement mechanism configured to move the choke valve along a direction parallel to the sealing surface such that the valve body moves in a closing direction in which the opening is closed and an opening direction in which the opening is opened;

a blowing back prevention plate provided integrally with the air cleaner body, the blowing back prevention plate having a disc shape and being disposed on an axial line of the suction pipe portion to face the opening;

a protrusion provided on the valve body of the choke valve, the protrusion protruding in a direction of the axial line from the valve body and configured to come into contact with the blowing back prevention plate when the movement mechanism operates and the valve body moves in the closing direction, wherein the valve body is pressed against the sealing surface to adhere to the sealing surface when the protrusion comes into contact with the blowing back prevention plate, wherein the blowing back prevention plate has a first surface on a side of the opening with which the protrusion comes into contact and a second surface on an opposite side from the first surface; and a rib for reinforcement provided on the second surface of the blowing back prevention plate, the rib extending in the opening and the closing direction, wherein a diameter of the blowing back prevention plate is equal to an inner diameter of the suction pipe portion, and wherein the protrusion is configured to make sliding contact with the blowing back prevention plate along substantially an entire length of the diameter of the blowing back prevention plate.

17. The choke valve structure according to claim 16, wherein the first surface is inclined with respect to the direction parallel to the sealing surface to press the valve body against the sealing surface as the valve body moves in the closing direction.

18. The choke valve structure according to claim 16, further comprising a connecting portion that extends in the direction of the axial line and connects the end wall to the blowing back prevention plate.

19. The choke valve structure according to claim 18, wherein the connecting portion is positioned below the axial line of the suction pipe portion, and forms a shape of a cylindrical surface which is open upward.

20. The choke valve structure according to claim 16, wherein the protrusion is configured to come into contact with the blowing back prevention plate prior to the protrusion passing through the axial line when the valve body moves in the closing direction.

* * * * *